US010317167B2

(12) United States Patent
Heinz

(10) Patent No.: US 10,317,167 B2
(45) Date of Patent: Jun. 11, 2019

(54) RECOIL REDUCTION STOCK

(71) Applicant: Mark Heinz, Gakona, AK (US)

(72) Inventor: Mark Heinz, Gakona, AK (US)

( * ) Notice: Subject to any disclaimer, the term of this patent is extended or adjusted under 35 U.S.C. 154(b) by 2 days.

(21) Appl. No.: 15/978,575

(22) Filed: May 14, 2018

(65) Prior Publication Data

US 2018/0335272 A1 Nov. 22, 2018

Related U.S. Application Data

(60) Provisional application No. 62/508,032, filed on May 18, 2017.

(51) Int. Cl.
*F41C 23/08* (2006.01)
*F41C 23/20* (2006.01)

(52) U.S. Cl.
CPC ..... *F41C 23/08* (2013.01); *F41C 23/20* (2013.01)

(58) Field of Classification Search
CPC ..... F41C 23/06; F41C 23/08; F41C 23/14; F41C 23/20
See application file for complete search history.

(56) References Cited

U.S. PATENT DOCUMENTS 935,822 A * 10/1909 Schmidt ..... F41C 23/08 42/74
1,042,132 A * 10/1912 Long ..... F41C 23/08 42/74
1,213,951 A * 1/1917 Ringsmith ..... F41C 23/08 42/74
1,328,700 A * 1/1920 Wagoner ..... F16F 15/067 42/74
1,785,977 A * 12/1930 Pruyn ..... F41C 23/06 42/74
1,842,527 A 1/1932 Knight
2,455,438 A * 12/1948 Oppold ..... F41C 23/06 42/73
3,019,543 A * 2/1962 Ducharme ..... F41C 23/06 42/74
3,233,354 A * 2/1966 Ahearn ..... F41C 23/06 42/74
3,714,726 A 2/1973 Braun
4,439,943 A * 4/1984 Brakhage ..... F41C 23/06 42/74

(Continued)

FOREIGN PATENT DOCUMENTS

DE 2231543 A1 * 1/1974 ..... F41C 23/06

*Primary Examiner* — Benjamin P Lee
(74) *Attorney, Agent, or Firm* — Global Intellectual Property Agency, LLC; Daniel Boudwin

(57) ABSTRACT

A recoil reduction stock. The device includes a shock absorber having a first end, a second end, and a spring channel extending therethrough. A coil spring is disposed within the spring channel. A spacer abuts the second end of the shock absorber, and the first end of the shock absorber contacts a rear edge of a firearm stock body. A lag stud is inserted through the spacer and the shock absorber, wherein a tip of the lag stud is configured to engage the firearm stock body, such that the spring is compressed between a rear edge of the firearm stock body and the spacer. A butt plate is affixed to the spacer, wherein the butt plate includes a hollow interior volume in which a head portion of the lag stud is disposed. The compressed shock absorber is adapted to resist expansion and absorb recoil energy when the firearm is fired.

18 Claims, 2 Drawing Sheets

(56) References Cited

U.S. PATENT DOCUMENTS

| | | | | | |
|---|---|---|---|---|---|
| 4,922,641 | A * | 5/1990 | Johnson | F41C 23/06 | 42/74 |
| 5,375,360 | A * | 12/1994 | Vatterott | F41C 23/08 | 42/74 |
| 5,471,776 | A * | 12/1995 | Chesnut | F41C 23/08 | 42/74 |
| 6,976,333 | B2 * | 12/2005 | Sims | F41C 23/08 | 42/74 |
| 7,743,544 | B2 | 6/2010 | Laney et al. | | |
| 8,296,986 | B1 | 10/2012 | Cook et al. | | |
| 2011/0113666 | A1 | 5/2011 | Latimer | | |
| 2016/0273874 | A1 * | 9/2016 | Butler | F41C 23/08 | |
| 2018/0017353 | A1 * | 1/2018 | Lesenfants | F41C 23/08 | |

* cited by examiner

RECOIL REDUCTION STOCK

CROSS REFERENCE TO RELATED APPLICATIONS

This application claims the benefit of U.S. Provisional Application No. 62/508,032 filed on May 18, 2017. The above identified patent application is herein incorporated by reference in its entirety to provide continuity of disclosure.

BACKGROUND OF THE INVENTION

The present invention relates to firearm stocks and devices for reducing recoil impact when a firearm is fired. More specifically the present invention provides a recoil reduction stock that can be affixed to an existing firearm stock, wherein the recoil reduction stock includes a compressed shock absorber that is configured to resist expansion and absorb recoil energy, thereby minimizing the transfer of recoil energy to the firearm user's body.

Many individuals utilize firearms for recreation, self-defense, or other purposes. When a firearm is fired, the force of the bullet being propelled from the firearm barrel causes a rearward force to be exerted on the firearm, which is commonly referred to as recoil. While recoil can be reduced via different internal components of the firearm, the reactive force that causes recoil will always occur to some degree when the firearm is fired. The recoil force causes the firearm to move rearward toward the user upon firing of the firearm, unless the user exerts an adequate counter-force to keep the firearm steady. It can be difficult to maintain steadiness in a firearm, particularly for weaker individuals or with firearms of a higher calibers that exert greater recoil forces when fired.

Longer firearms, e.g. shotguns and rifles, typically have a stock which rests against the user's shoulder when the user holds the firearm. The stock is typically a single, solid piece of metal, wood, or composite material. The stock absorbs some of the recoil energy when the firearm is figured, using the user's shoulder to steady the firearm and prevent excessive rearward movement thereof. While traditional firearm stocks reduce some recoil, a great deal of energy is still imparted to the user. The recoil energy additionally causes the gun to move upward, reducing the accuracy shots fired consecutively. Further, the recoil energy is ultimately absorbed by the user's body and may cause soreness or more serious injury to the user's shoulder or other body part. In view of the above concerns, it is therefore desirable to provide a recoil reduction stock that absorbs recoil energy in order to minimize the amount of recoil energy transferred to the user's body.

Devices have been disclosed in the known art that relate to recoil reduction stocks and stock attachments. However, these devices have several drawbacks. One example of such a device includes a rubber pad securable to the end of a firearm stock, which has a second rubber pad affixed thereto via one or more springs. The second rubber pad contacts the user's body while the springs absorb recoil energy. However, these devices lack a component that is biased toward the firearm barrel to a compressed position or configuration. The lack of such a component renders the device less effective than a recoil reduction stock that includes compressed layers that can resist expansion to more effectively absorb recoil energy.

In light of the devices disclosed in the known art, it is submitted that the present invention substantially diverges in design elements from the known art and consequently it is clear that there is a need in the art for an improvement to existing firearm stocks and recoil reduction devices. In this regard, the present invention substantially fulfills these needs.

SUMMARY OF THE INVENTION

In view of the foregoing disadvantages inherent in the known types of firearm stocks now present in the prior art, the present invention provides a recoil reduction wherein the same can be utilized for providing convenience for the user when absorbing the recoil energy of a firearm and preventing the recoil energy from transferring to the user's body. The present system recoil reduction stock includes a shock absorber having a first end, a second end, and a spring channel extending between the first end and the second end. A coil spring is disposed within the spring channel. A spacer abuts the second end of the shock absorber, and the first end of the shock absorber contacts a rear edge of a firearm stock body. A lag stud is inserted through the spacer and the shock absorber, wherein a tip of the lag stud is configured to engage the firearm stock body, such that the spring is compressed between a rear edge of the firearm stock body and the spacer. A butt plate is affixed to the spacer, the butt plate including a hollow interior volume in which a head portion of the lag stud is disposed. The shock absorber is adapted to expand and absorb recoil energy when the firearm is fired.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
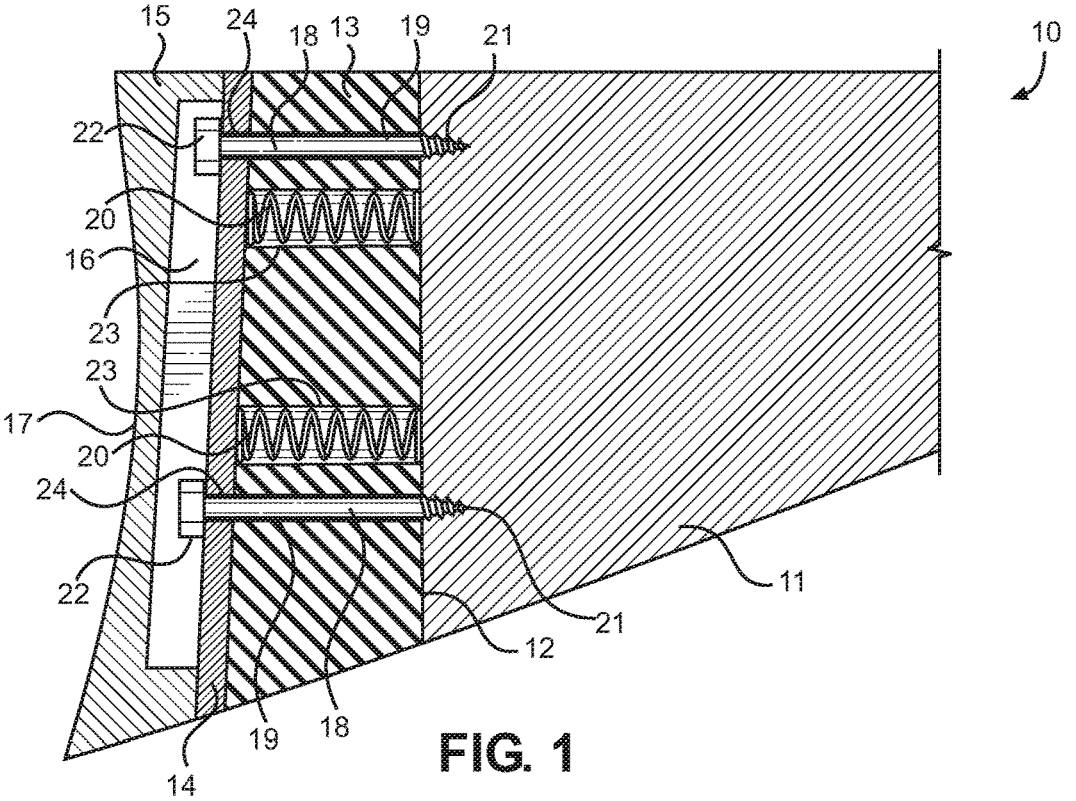
FIG. 1 shows a cross-sectional side view of an embodiment of the recoil reduction stock.

Reference is made herein to the attached drawings. Like reference numerals are used throughout the drawings to depict like or similar elements of the recoil reduction stock. For the purposes of presenting a brief and clear description of the present invention, the preferred embodiment will be discussed as used for absorbing recoil energy and preventing recoil energy from being imparted to the user's body upon firing a firearm. The figures are intended for representative purposes only and should not be considered to be limiting in any respect.

Referring now to FIG. 1, there is shown a cross-sectional side view of an embodiment of the recoil reduction stock. The recoil reduction stock 10 generally includes a shock absorber 13, a spacer 14, and a butt plate 15. A first end of the shock absorber 13 contacts a rear edge 12 of a stock body 11 of a firearm. In some embodiments, the shock absorber 13 is integral to the firearm stock body 11. In other embodiments, the shock absorber 13 may be secured to a firearm stock body 11 which has had a rear portion thereof removed, such that the firearm stock body 11 defines a straight rear edge 12 which makes flush or continuous contact with the first end of the shock absorber 13.

The shock absorber 13 includes a spring channel 23 extending therethrough along a longitudinal length of the firearm stock body 11. The shock absorber is composed of a material that is configured to be compressible, such as a rubber material, for example. The compressible material allows the shock absorber 13 to absorb recoil energy when the firearm is fired. A coil spring 20 is disposed within the spring channel 23 for further absorption of recoil forces. In the shown embodiment, the recoil reduction stock 10 includes a pair of spring channels 23 and a pair of coil springs 20 disposed therein. However, alternate embodiments may include a greater or fewer number of spring channels 23 and corresponding coil springs 20.

The spacer 14 abuts the second end of the shock absorber 13. The spacer 14 is composed of a rigid, incompressible material, such as a rigid plastic, metal, or the like. A lag stud 18 is inserted through the spacer 14 and the shock absorber 13, such that a tip 21 of the lag stud 18 engages the firearm stock body 11. In the shown embodiment, the tip 21 comprises threading thereon, such that the tip 21 can be screwed into a wooden firearm stock body 11. A head portion 22 of the lag stud 18 contacts the spacer 14, such that the spacer 14 and shock absorber 13 are secured to and compressed against the firearm stock body 11. In one embodiment, the head portion 22 comprises a lock nut secured to an elongated body of the lag stud 18. The lock nut can be tightened or loosened to adjust the compression of the spring 20 and shock absorber 13. The coil spring 20 is by default compressed between the spacer 14 and the shock absorber 13, such that the shock absorber 13 resists expansion and potential energy is stored within the coil spring 20.

In the shown embodiment, the lag stud 18 extends through an aperture 25 of the spacer 14 and a lag stud channel 19 of the shock absorber 13 that is disposed adjacent to the spring channel 23. In the shown embodiment, the recoil reduction stock 11 includes a pair of lag studs 18 and a pair of corresponding lag stud channels 19. However, in alternate embodiments, a greater or fewer number of lag studs 18 may be utilized.

The butt plate 15 is secured to the side of the spacer 14 opposing the shock absorber 13. The butt plate 15 can be integral to the spacer or may be secured thereto via any suitable fastener, such as a screw, for example. The butt plate 15 includes a hollow interior volume 16 in which the head portion 22 of the lag stud 18 is disposed. The butt plate 15 is composed of a material that is configured to be compressible, such as rubber, for example. In the shown embodiment, the butt plate 15 comprises an arcuate rear edge 17, such that the butt plate can comfortably rest against a user's shoulder and conform to the shape thereof.

Figure 2:
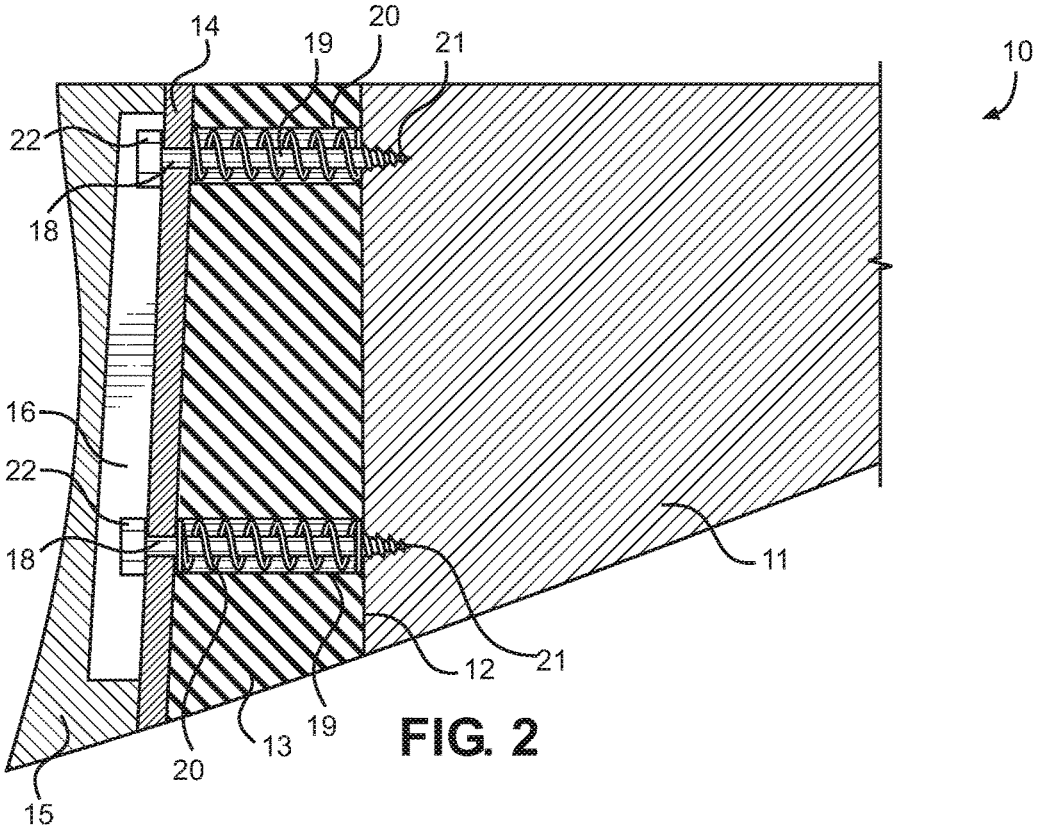
FIG. 2 shows a cross-sectional side view of an alternate embodiment of the recoil reduction stock.

Referring now to FIG. 2, there is shown a cross-sectional side view of an alternate embodiment of the recoil reduction stock. In the shown embodiment, the lag stud 18 is inserted through the center of the coil spring 20, whereby the coil spring 20 encircles the lag stud 18. In this embodiment, the lag stud 18 and the coil spring 20 occupy a common channel extending through the shock absorber 13. In such embodiments, the lag stud aperture 24 is aligned with the spring channel 23. This embodiment provides a more compact arrangement of springs and studs, allowing for less channels to be formed through the shock absorber 13.

Figure 3:
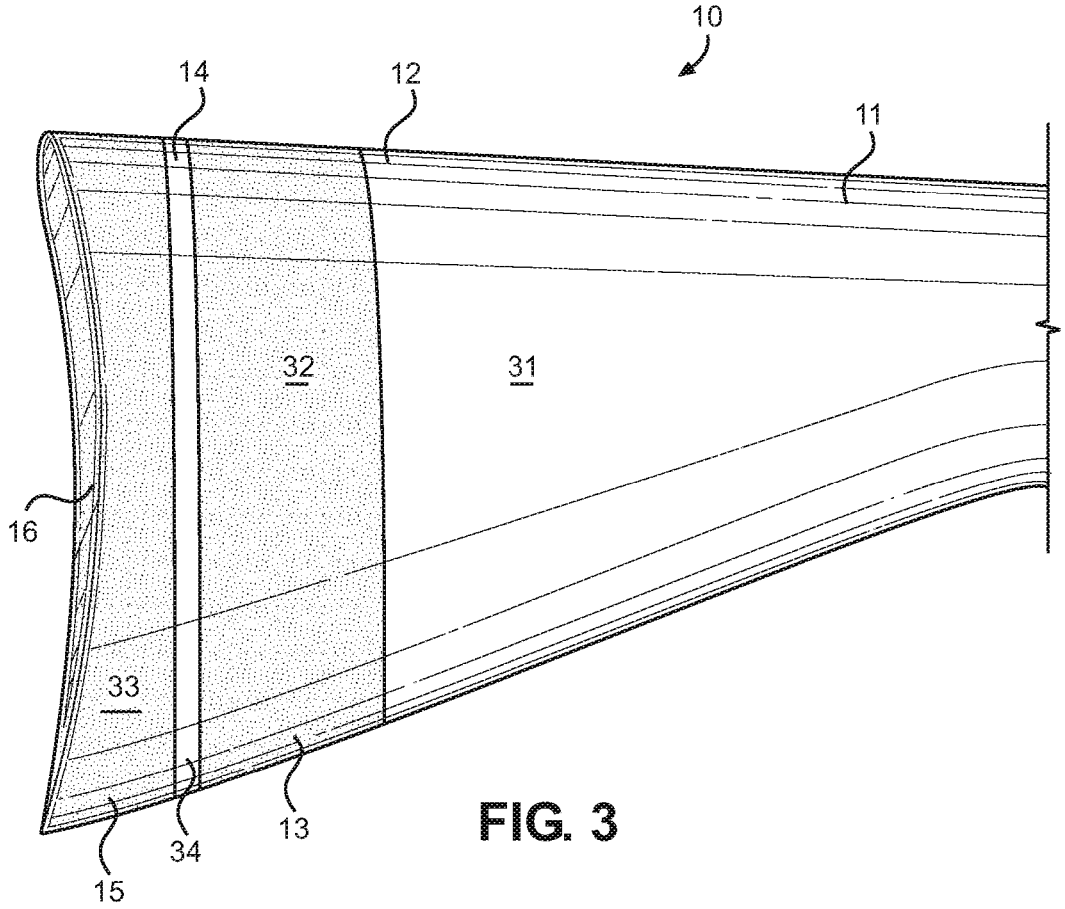
FIG. 3 shows a perspective view of an embodiment of the recoil reduction stock.

Referring now to FIG. 3, there is shown a perspective view of an embodiment of the recoil reduction stock. When installed, the recoil reduction stock 10 provides a clean appearance resembling a typical firearm stock. For example, an outer surface 31 of the firearm stock body 11, an outer surface 32 of the shock absorber 13, an outer surface 34 of the spacer 14, and an outer surface 33 of the butt plate 15 are continuous or flush with each other. Additionally, the rear edge 16 of the butt plate 15 may include the shape of any known rifle stock rear edge, such that the butt plate 15 rests comfortably against the user.

When the user fires the firearm, the recoil exerts a rearward force on the firearm. The shock absorber 13 and coil springs 20 are configured to absorb the recoil force, whereby the default compressed state of the shock absorber 13 and coil springs 20 serves to reduce the force that is ultimately imparted to the user's body. The compressible nature of the butt plate 15 allows the butt plate 15 to absorb additional recoil energy when the firearm is fired, whereby the hollow interior volume shown in FIGS. 1 and 2 permit travel of the butt plate 15. In this way, the compressed shock absorber 13 and coil springs, in conjunction with the compressible butt plate 15, are adapted to absorb recoil energy that would otherwise be imparted on the firearm user's body.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A recoil reduction stock, comprising:

a shock absorber comprising a first end, a second end, and a spring channel extending through the first and second ends;

a coil spring disposed within the spring channel, wherein the coil spring is configured to directly engage a main stock body of a firearm;

a spacer abutting the second end of the shock absorber;

a lag stud inserted through the spacer and the shock absorber, wherein a tip of the lag stud is configured to engage the main stock body of the firearm, such that the spring is compressed between a rear edge of the main stock body and the spacer;

a butt plate comprising a hollow interior volume in which a head of the lag stud is disposed;

wherein when the firearm is fired, the shock absorber and the coil spring compress and absorb recoil energy, and a distance between the lag stud head and the spacer is increased.

2. The recoil reduction stock of claim 1, wherein the lag stud is inserted through a lag stud channel of the shock absorber, wherein the lag stud channel is disposed adjacent the spring channel.

3. The recoil reduction stock of claim 1, wherein the lag stud is inserted through the spring channel of the shock absorber, such that the coil spring encircles the lag stud.

4. The recoil reduction stock of claim 1, wherein the lag stud head comprises a lock nut secured to an elongated body of the lag stud.

5. The recoil reduction stock of claim 1, wherein the lag stud tip comprises threading thereon.

6. The recoil reduction stock of claim 1, wherein the spacer is composed of a material that is configured to be rigid and incompressible.

7. The recoil reduction stock of claim 1, wherein the shock absorber is composed of a material that is configured to be compressible.

8. The recoil reduction stock of claim 1, wherein the butt plate is composed of a material that is configured to be compressible.

9. The recoil reduction stock of claim 1, wherein the butt plate comprises an arcuate rear edge.

10. A firearm stock, comprising:

a firearm stock body;

a recoil reduction stock affixed to the firearm stock body, the recoil reduction stock comprising:

a shock absorber comprising a first end, a second end, and a spring channel extending through the first and second ends;

a coil spring disposed within the spring channel, wherein the coil spring is configured to directly engage the firearm stock body;

a spacer abutting the second end of the shock absorber;

a lag stud inserted through the spacer and the shock absorber, wherein a tip of the lag stud engages the firearm stock body, such that the spring is compressed between a rear edge of the firearm stock body and the spacer;

a butt plate comprising a hollow interior volume in which a head of the lag stud is disposed;

wherein when a firearm connected to the firearm stock body is fired, the shock absorber and the coil spring compress and absorb recoil energy, and a distance between the lag stud head and the spacer is increased.

11. The firearm stock of claim 10, wherein the lag stud is inserted through a lag stud channel of the shock absorber, wherein the lag stud channel is disposed adjacent the spring channel.

12. The firearm stock of claim 10, wherein the lag stud is inserted through the spring channel of the shock absorber, such that the coil spring encircles the lag stud.

13. The firearm stock of claim 10, wherein the lag stud head comprises a lock nut secured to an elongated body of the lag stud.

14. The firearm stock of claim 10, wherein the lag stud tip comprises threading thereon.

15. The firearm stock of claim 10, wherein the spacer is composed of a material that is configured to be rigid and incompressible.

16. The firearm stock of claim 10, wherein the shock absorber is composed of a material that is configured to be compressible.

17. The firearm stock of claim 10, wherein the butt plate is composed of a material that is configured to be compressible.

18. The firearm stock of claim 10, wherein the butt plate comprises an arcuate rear edge.

* * * * *